US006229970B1

(12) United States Patent
Onimura et al.

(10) Patent No.: US 6,229,970 B1
(45) **Date of Patent: *May 8, 2001**

(54) IMAGE FORMING APPARATUS WITH AN AMOUNT OF USE CONTROL FEATURE AND CARTRIDGE REMOVABLY MOUNTED ON THE APPARATUS

(75) Inventors: Tadashi Onimura, Toride; Koichi Suwa, Ushiku; Kazumi Yamauchi, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/736,088

(22) Filed: Oct. 24, 1996

(30) Foreign Application Priority Data

Oct. 25, 1995 (JP) ..... 7-299345

(51) Int. Cl.[7] ..... G03G 15/02
(52) U.S. Cl. ..... 399/50; 399/25; 399/43
(58) Field of Search ..... 399/50, 43, 25, 399/8, 9, 11, 18, 21, 27, 111

(56) References Cited

U.S. PATENT DOCUMENTS

| | | | | |
|---|---|---|---|---|
| 4,905,023 | * | 2/1990 | Suzuki | 347/252 |
| 4,965,747 | * | 10/1990 | Ohtsuka et al. | 395/107 |
| 4,989,044 | | 1/1991 | Nishimura et al. | 355/251 |
| 5,272,503 | * | 12/1993 | LeSueur et al. | 399/25 |
| 5,737,663 | * | 4/1998 | Handa et al. | 399/50 |
| 5,930,553 | * | 7/1999 | Hirst et al. | 399/8 |

FOREIGN PATENT DOCUMENTS

| | | | |
|---|---|---|---|
| 2-072381 | * | 3/1990 | (JP) . |
| 4-000456 | * | 1/1992 | (JP) . |
| 8-160680 | * | 6/1996 | (JP) . |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes a photosensitive member, a charging device for charging the photosensitive member, an exposing device for exposing a light including image information to the photosensitive member, and a developing device for supplying a toner to an electrostatic latent image formed on said photosensitive member. The developing means is held by a cartridge removably mountable on a main body of the image forming apparatus. The cartridge includes a memory for memorizing an amount of use of the cartridge, wherein a charging amount of the toner caused by friction in the cartridge when the amount of use of the cartridge is in an initial state is smaller than that when the amount of use of said cartridge is not in an initial state. A judging device compares the amount of use of the cartridge with a predetermined value showing a condition that the amount of use of the cartridge is in the initial state. A control device controls operating parameters relating to at least one of the charging device, the exposing device, and the developing device, in accordance with a compared result of the judging device, so as to prevent thinning of an image line width until the amount of use of the cartridge reaches the predetermined value. The control device changes the operating parameters until the amount of use of the cartridge reaches the predetermined value, and sets the operating parameters to be constant after the amount of use of the cartridge reaches the predetermined value.

6 Claims, 11 Drawing Sheets

IMAGE FORMING APPARATUS WITH AN AMOUNT OF USE CONTROL FEATURE AND CARTRIDGE REMOVABLY MOUNTED ON THE APPARATUS

BACKGROUND OF THE INVENTION

1. Field of the Invention

This invention relates to an image forming apparatus using the electrophotographic art such as a copying apparatus or a printer and to a cartridge removably mountable on this apparatus.

2. Related Background Art

In an image forming apparatus using an electrophotographic image forming process, there has heretofore been adopted a process cartridge system in which an electrophotographic photosensitive member and process means acting on the electrophotographic photosensitive member are integrally made into a cartridge which is removably mountable on an image forming apparatus body. According to this process cartridge system, the maintenance of the apparatus can be done by a user himself without resorting to a serviceman and therefore, operability could be markedly improved. So, this process cartridge system is widely used in image forming apparatuses.

Now, in an image forming apparatus using the aforedescribed cartridge system, to develop an electrostatic latent image formed on a photosensitive drum with a toner caused to adhere thereto, it is necessary for the toner to have a moderate charge (hereinafter referred to as the "tribo"). In the case of a developing device shown, for example, in FIG. 14 of the accompanying drawings, a toner 5 supplied onto a developing roller 7 (developer carrying member) is frictionally contacted by a developing blade 6 (developer regulating member) adhesively secured to a metal plate 6*a* when the developing roller 7 is rotated in the direction of arrow. Thereby, the toner 5 may be frictionally charged.

However, in a state shortly after the cartridge has begun to be used, i.e., the initial state, the toner 5 in the developing device 4 is scarcely charged. The charged toner 5 remaining on the developing sleeve 7 during development with the image forming operation repeated is collected into the developing device 4 and is agitated by an agitating bar 8 and is circulated in the developing device 4, whereby the tribo of the toner 5 in the developing device 4 gradually becomes higher.

Therefore, in the initial state of use of the cartridge, the tribo of the toner 5 on the developing sleeve 7 is low and a sufficient quantity of toner 5 does not adhere to the photosensitive drum 1. Thus, the density of a printed image has been reduced and a line width constituting characters, figures, etc. has become thin, and by the cartridge being used to some extent, the line width and the density of the image have sometimes been recovered.

SUMMARY OF THE INVENTION

It is an object of the present invention to prevent the fluctuation of the density of printed images and a line width constituting characters or figures in the initial state of use of a cartridge and a state after the cartridge has been used for a while.

It is another object of the present invention to provide an image forming apparatus in which a cartridge removably mountable on the apparatus body has memory means for memorizing the amount of use of the cartridge, and has control means for controlling the applied voltage to a charging member in conformity with the amount of use of the cartridge.

It is still another object of the present invention to provide a cartridge having developing means for supplying a developer to an image bearing member in an apparatus body, and memory means for storing therein information for changing over a voltage applied to a charging member in the apparatus body.

It is yet still another object of the present invention to provide a process cartridge having an image bearing member, a charging member, developing means and memory means for storing therein information for changing over a voltage applied to the charging member.

Further objects of the present invention will become apparent from the following detailed description taken in conjunction with the accompanying drawings.

DESCRIPTION OF THE PREFERRED EMBODIMENTS

An image forming apparatus, a process cartridge and a developing device according to the present invention will hereinafter be described in detail with reference to the drawings.

Embodiment 1

Figure 1:
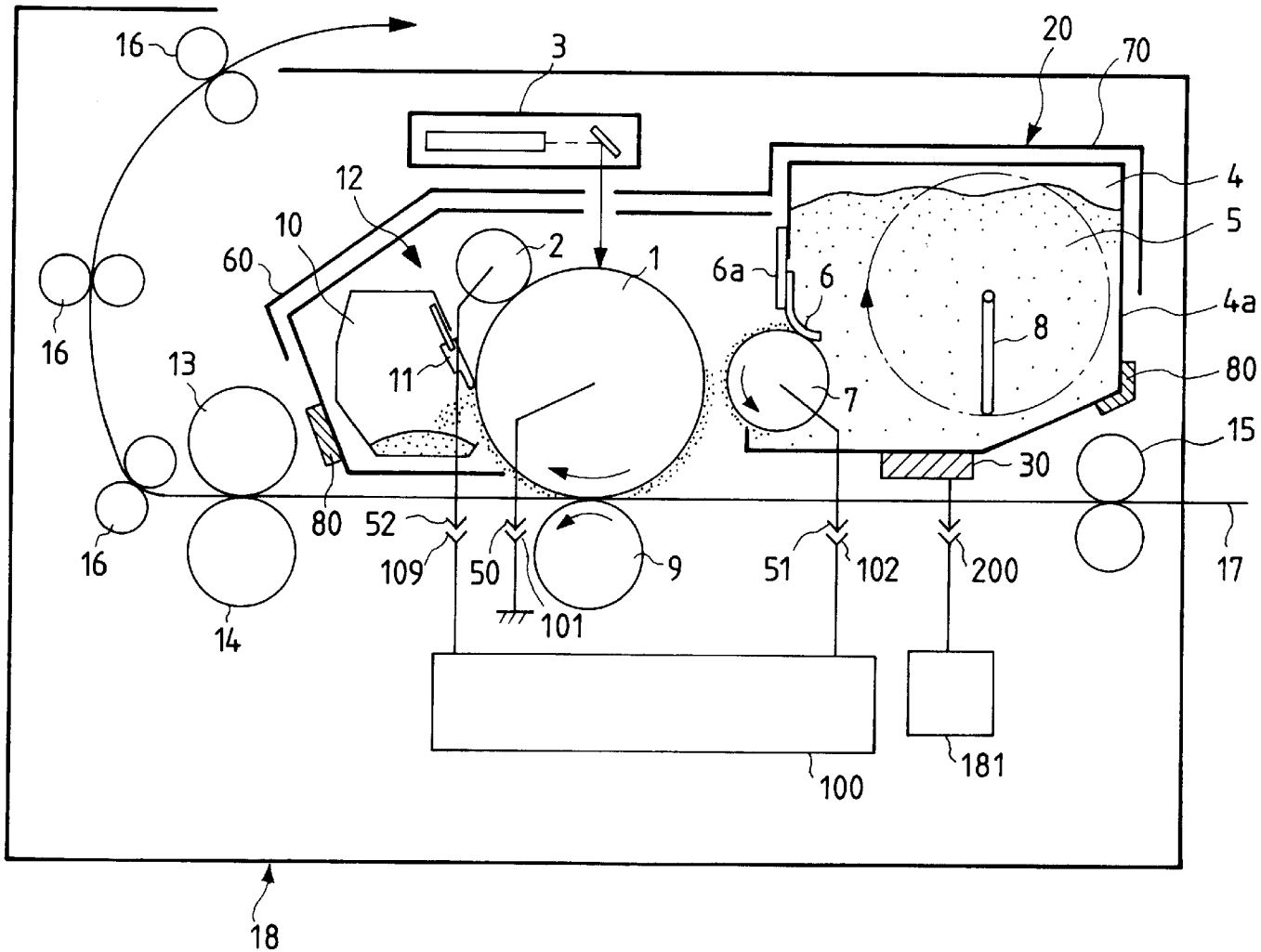
FIG. 1 schematically shows the construction of an embodiment of an image forming apparatus according to the present invention.

Reference is first made to FIGS. 1 to 9 to describe an embodiment of an image forming apparatus on which a process cartridge constructed in accordance with the present invention is mountable. FIG. 1 schematically shows an electrophotographic image forming apparatus using a process cartridge (hereinafter referred to as the "cartridge") for effecting image formation by the utilization of reverse development.

Figure 2:
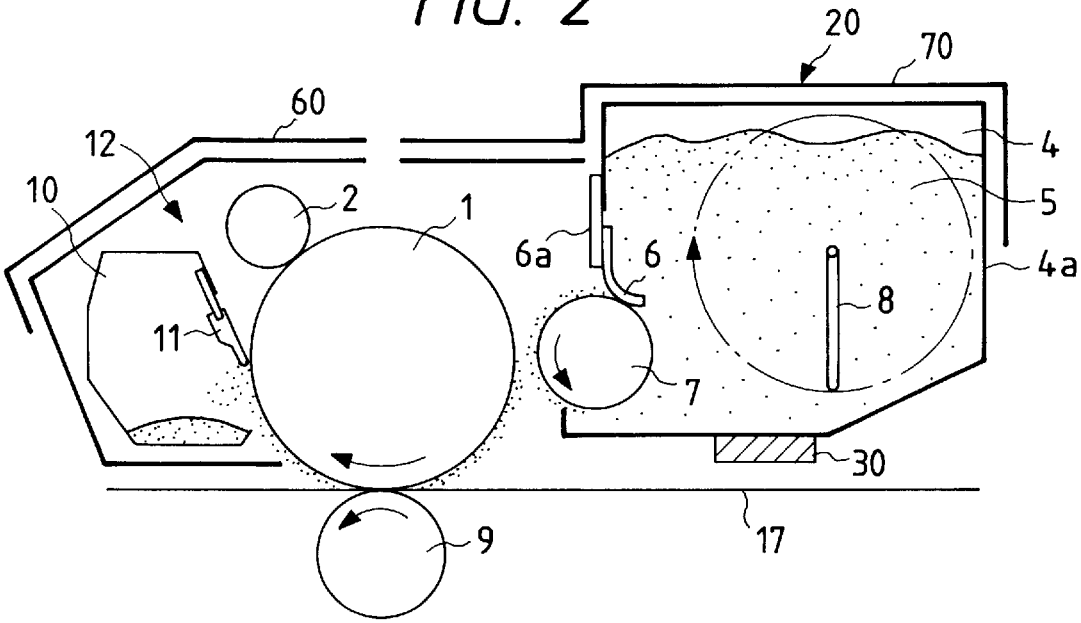
FIG. 2 shows the construction of a process cartridge mounted on the image forming apparatus of FIG. 1.

In this embodiment, the cartridge 20, as shown in FIG. 2, comprises a photosensitive drum unit 12 in which a photosensitive drum (electrophotographic photosensitive member) 1, a charging roller (charging means) 2 and a cleaner unit (cleaning means) 10 including a cleaning blade 11 are made integral with each other, and a developing device 4 made integral therewith by frame members 60 and 70, and is interchangeable relative to an apparatus body 18 through mounting guide means 80, as shown in FIG. 1.

Also, a transfer roller 9 (transfer charging means) is disposed in the apparatus body 18 positioned below the photosensitive drum 1 in the cartridge 20. Further, sheet supply rollers 15 are disposed on the sheet supply side with respect to the transfer roller 9. On the paper discharge side, there are disposed a fixating roller 13 for fixating a toner 5 transferred to recording paper, a pressure roller 14 for urging the recording sheet against the fixating roller 13 to assist in fixation, and sheet discharge rollers 16 constituting a part of conveying means for discharging the recording sheet on which the toner has been fixated out of the main body of apparatus (apparatus body) 18 as indicated by arrow.

Further, above the cartridge 20, there is disposed an exposure device 3 for irradiating the photosensitive drum 1 charged by the charging roller 2 with a laser beam and forming an electrostatic latent image on the photosensitive surface of the drum 1. The developing device 4 is provided with a developing container 4*a* containing a toner 5 therein, a developing roller 7 rotatably provided in the opening portion of the developing container 4*a*, a developing blade 6 adhesively fixed to a metallic plate 6*a* fixed to the developing container 5*a* for regulating the thickness of a toner layer on the developing roller 7, and an agitating bar 8 for agitating the toner moved to the developing blade 7 side.

In the apparatus body 18, there is provided a high voltage unit 100 for applying a bias to the developing roller 7 and the charging roller 2, and between the developing roller 7 and the high pressure unit 100, there are disposed a developing roller electrode 51 for receiving a developing bias, and a developing bias electrode 102 linking the developing roller electrode 51 and the high voltage unit 100 together and applying a developing bias to the developing roller electrode 51. There are also disposed a charging roller electrode 52 for receiving a primary bias applied from the high pressure unit 100 to the charging roller 2, and a primary bias electrode 109 linking the charging roller electrode 52 and the high voltage unit 100 together and applying a primary bias to the charging roller electrode 52.

There are further provided a drum earth electrode 50 for taking the earth of the photosensitive drum 1, and a body side earth electrode 101 connected to the drum earth electrode 50 and connected to an electrically conductive metallic frame, not shown. Also, memory means 30 using a non-volatile memory is mounted on the cartridge 20, in the case of the present embodiment, on the lower portion of the developing device 4, and is connected to a CPU 181 disposed in the apparatus body 18 through a connector 200.

The image forming process of this image forming apparatus will be described hereinafter.

The photosensitive drum 1 is rotated in one direction about the axis thereof and has its surface uniformly charged by a primary bias comprising an AC component and a DC component superposed one upon the other which is supplied from the high voltage unit 100 to the charging roller 2. Whereafter an electrostatic latent image is formed on the surface of the photosensitive drum 1 by a laser beam applied from the exposure device 3. The developing roller 7 receives the supply of the toner 5 from within the developing container 4*a*, and the toner 5 uniformly applied to the surface thereof by the developing blade 6 is caused to adhere to the electrostatic latent image on the photosensitive drum 1 by the developing bias from the high voltage unit 100 to thereby visualize the electrostatic latent image.

On the other hand, the sheet supply rollers 15 feed sheet (recording medium) 17 from the outside of the image forming apparatus 18 into the nip between the photosensitive drum 1 and the transfer roller 9. The image on the photosensitive drum 1 visualized by the toner 5 is transferred onto the sheet 17 by the transfer roller 9. The toner 5 transferred onto the sheet 17 is fixated by the heat generated by the fixating roller 13 and the pressure applied by the pressure roller 14 and becomes a recorded image. Thereafter, the sheet 17 is discharged out of the image forming apparatus 18 by the discharge rollers 16. Any residual toner remaining untransferred on the photosensitive drum 1 is removed by the cleaning blade 11 mounted on the cleaning unit 10, whereafter the photosensitive drum 1 is again uniformly charged by the charging roller 2 and thereafter, the above-described steps are repeated.

Also, the print number of sheets, i.e., the number of printed sheets, inputted from the CPU 181 is stored in the aforementioned memory means 30, and a print number of sheets is increased each time printing is effected on a sheet. The information to be stored in this memory means 30 is not specially limited if the amount of use of the cartridge 20 can be judged by the image forming apparatus 18. As such information, mention may be made, for example, of the application time of the primary charge to the photosensitive drum 1, the information regarding the driving time of the drum, etc.

When the cartridge 20 is mounted on the image forming apparatus 18, the memory means 30 is connected to the CPU 181. The print number of sheets is sequentially written into or read out of the memory means 30 by the CPU 181. The present embodiment is characterized in that when it is judged from the print number of sheets stored in the memory means 30 that it is soon after the cartridge 20 has begun to be used, the voltage of the primary bias supplied to the charging roller 2 by the high pressure unit 100 is lowered.

Description will hereinafter be made of the reason why the voltage of the primary bias is lowered.

Figure 3:
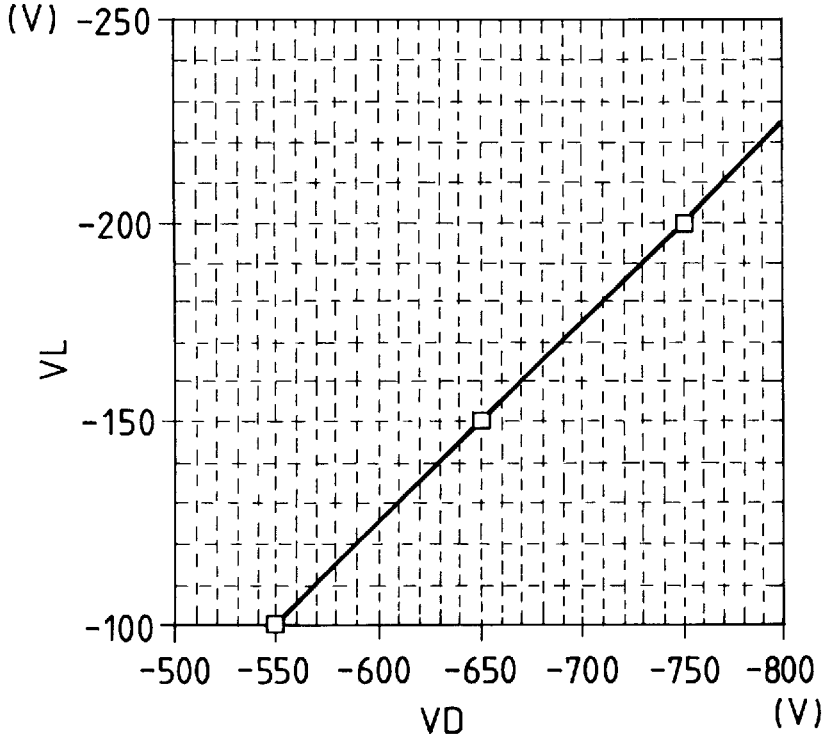
FIG. 3 is a graph showing the relation between the potential of the exposed portion of a photosensitive drum and the potential of the non-exposed portion of the photosensitive drum.

The potential when the surface of the photosensitive drum 1 is charged with the primary bias is defined as $V_D$, and the potential lowered with exposure is defined as $V_L$. Also, the developing bias applied to the developing roller 7 is defined as $V_{DC}$. The developing bias $V_{DC}$ is lower than $V_D$ and higher than $V_L$. Further, the potential difference between $V_L$ and the developing bias $V_{DC}$ is defined as contrast potential $V_{CNT}$. When $V_D$ is made lower than usual, $V_L$ also becomes lower. The relation between $V_D$ and $V_L$ on the photosensitive drum 1 used in the image forming apparatus 18 of the present embodiment is shown in the graph of FIG. 3. As shown in the graph of FIG. 3, $V_L$ when $V_D$ is −650V is −150V. In contrast, $V_L$ when $V_D$ is lowered to −550V is as low as −100V.

In the reverse development effected in the image forming apparatus 18 of the present embodiment, to develop an electrostatic latent image with the toner 5 by the contrast potential $V_{CNT}$ which is the potential difference between the developing roller 7 and the photosensitive drum 1, more of the toner 5 comes to adhere to the $V_L$ portion as the value of the contrast potential $V_{CNT}$ becomes greater. So, in the initial state of the cartridge 20 in which the tribo of the toner 5 is low and the developing property is low, the developing bias $V_{DC}$ is made to be constant and $V_D$ is made to be low and $V_L$ is made to be appropriate. Accordingly a developing property in which the tribo is high and which is equal to the states other than the initial state.

Figure 4:
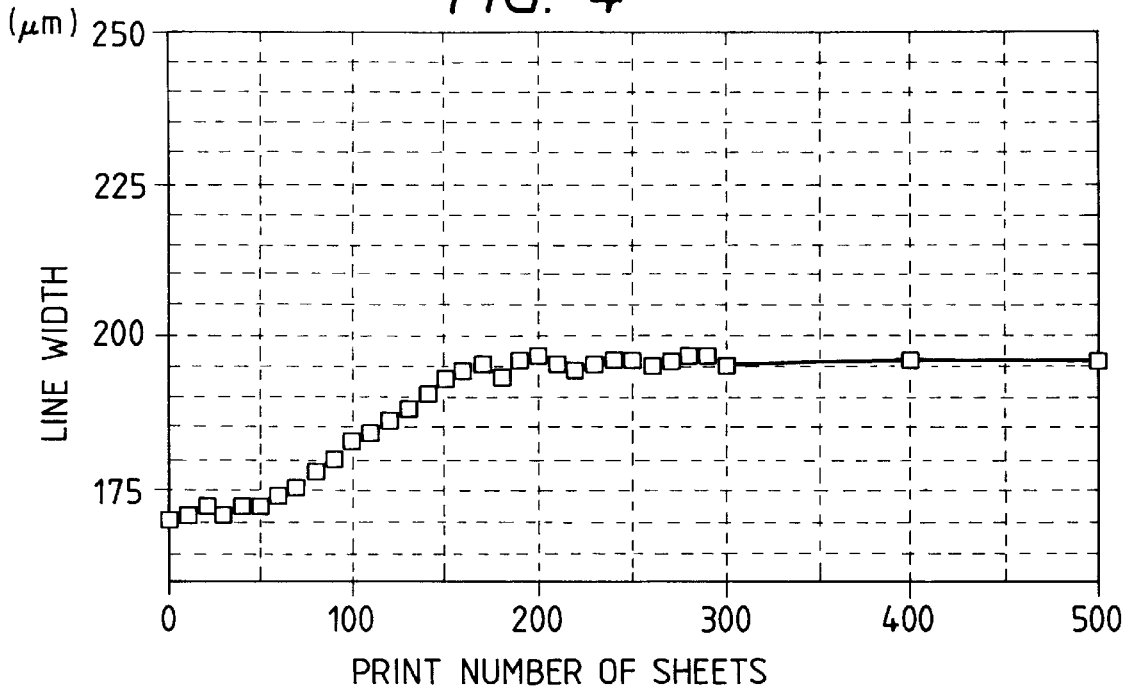
FIG. 4 is a graph showing the relation between the print number of sheets, i.e. number of printed sheets and a line width.

In the case of the image forming apparatus 18 of the present embodiment, $V_D$ is −650V, $V_L$ is −150V, the developing bias $V_{DC}$ is −500V and the contrast potential $V_{CNT}$ is 350V, the change in the line width of a printed image from the time from the start of printing after the cartridge 20 is interchanged until 500 sheets are printed is as shown in the graph of FIG. 4. From this graph, it will be seen that in the image forming apparatus 18, if about 150 sheets are printed, there is obtained a sufficient printing line width and the apparatus is no longer in the initial state. As a matter of course, the sufficient printing line width and the print density of sheets differ depending on the setting conditions or the like of the image forming apparatus and the process cartridge.

Figure 5:
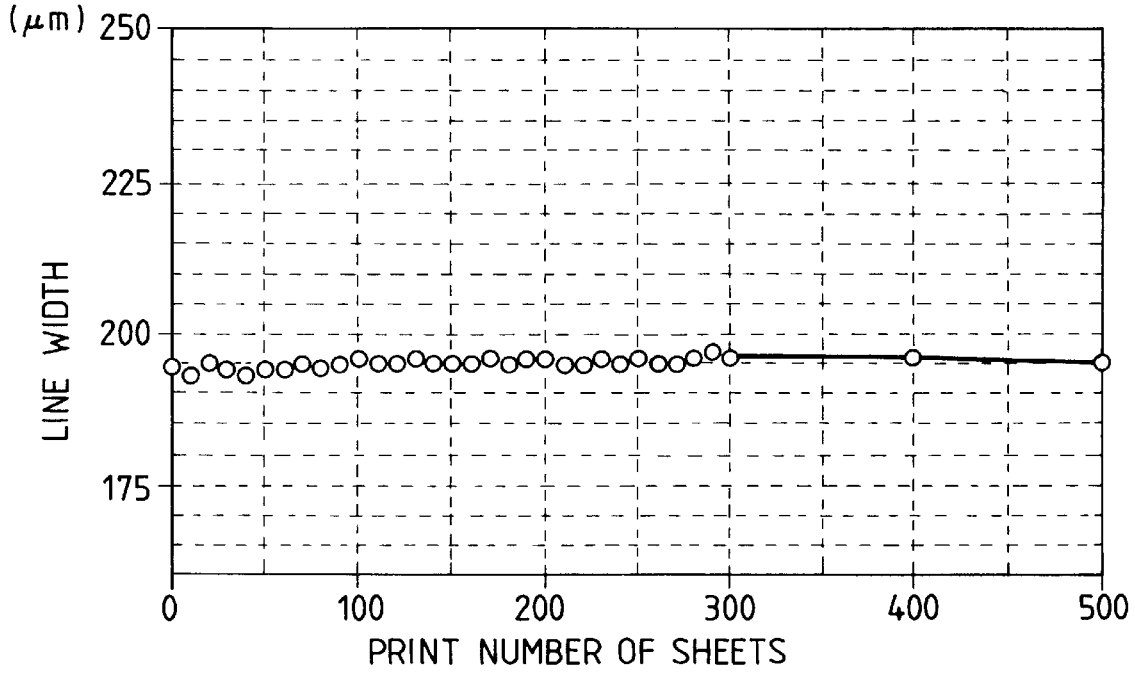
FIG. 5 is a graph showing the relation between the print number of sheets and a line width in Embodiment 1 of the image forming apparatus according to the present invention.

Also, in the graph of FIG. 4, the fluctuation of the printing line width is not constants. However, it hardly changes from the initial stage up to the 50th sheet, and changes substantially linearly after that. So, in the present embodiment, for the initial stage up to the 50th sheet, $V_D$ has been −550V, $V_L$ has been −100V and the contrast potential $V_{CNT}$ has been 400V. Also, for the 50th sheet to the 150th sheet, $V_D$ has been made higher by 10V for every ten sheets so as to prevent the line width from becoming too thick. Thereupon, the then line width changes as shown in the graph of FIG. 5. Also, the thin density at the initial stage of use did not occur.

Thus, in the voltage embodiment, the high pressure unit has been controlled so that the print number of sheets stored in the memory means 30 of the cartridge 20, $V_D$ may be −550V within 50 sheets, and $V_D$ may be increased by 10V for every 15 sheets up to the 200th sheet. Specifically, in the present embodiment, for the print number of sheets ranging from 50 sheets to 150 sheets, the voltage outputted by the high voltage unit 100 was controlled on the basis of the following equation:

$$\text{output voltage} = -650 + (100 - [\text{print number of sheets} - 50/10] \times 10) \quad \text{(A)}$$

The control of the image forming apparatus 18 of the present embodiment will hereinafter be described with reference to FIGS. 6 and 7.

Figure 6:
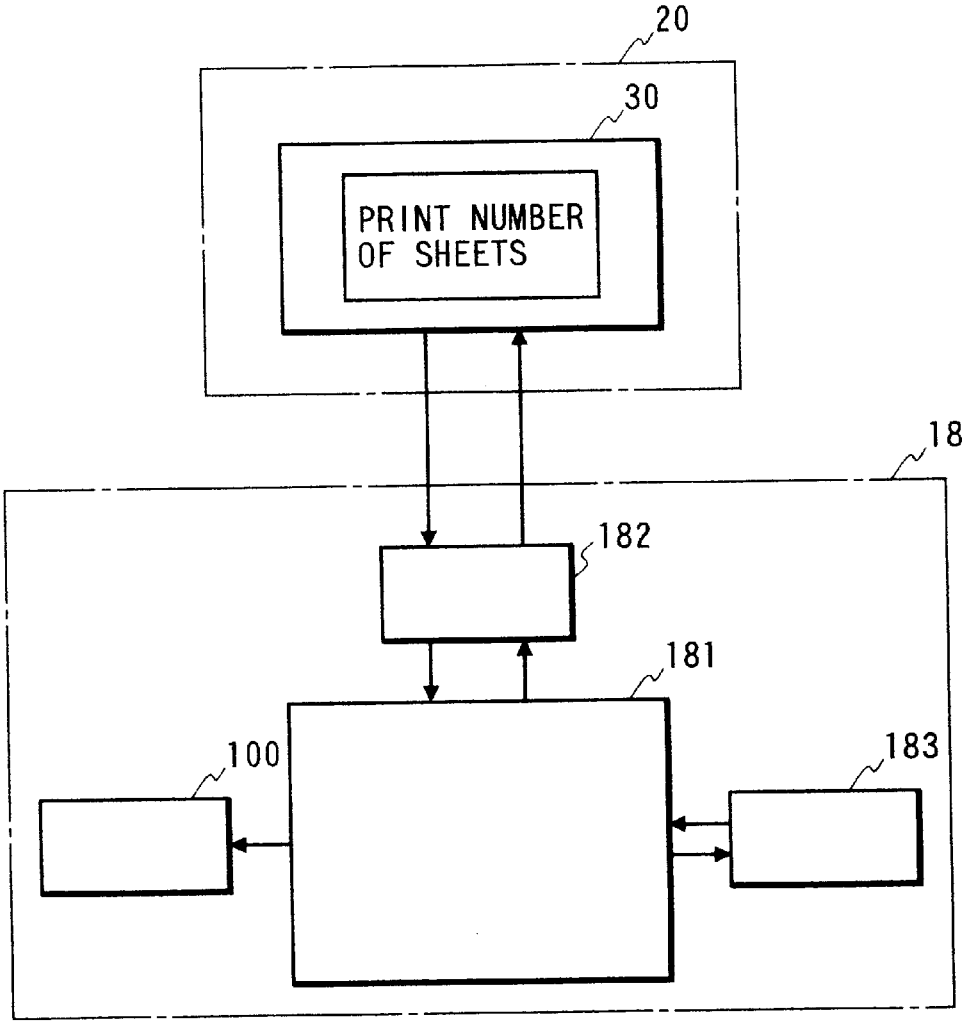
FIG. 6 is a block diagram of Embodiment 1.
Figure 7:
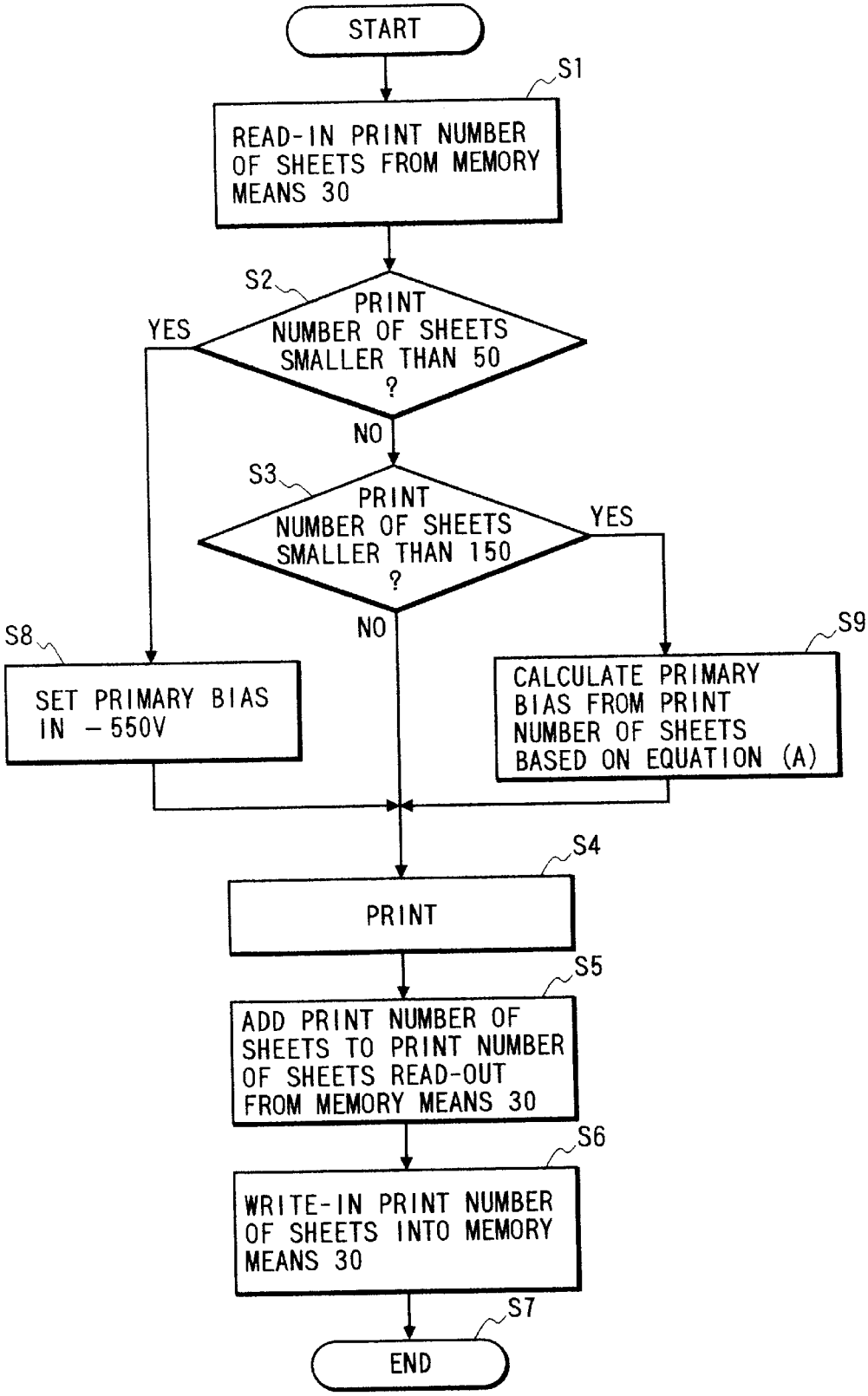
FIG. 7 is a flowchart of Embodiment 1.

In FIG. 6 showing a block diagram of the present embodiment, the cartridge 20 is provided with memory means 30 storing the print number of sheets therein. The image forming apparatus 18 is provided with reading-out/writing-in means 182 for effecting the reading-out and writing-in of information relative to the memory means 30, judging means 183 for judging the amount of use of the cartridge 20 by the information read out from the memory means 30, a high voltage unit 100 and a CPU 181. The judging means 183 transmits a signal to the CPU 181 when it is judged from the print number of sheets stored in the cartridge 20 that it is soon after the cartridge 20 has begun to be used. The CPU 181, when it receives the signal from the judging means 183, controls so as to lower the voltage of the primary bias outputted by the high voltage unit 100. At this time, the CPU 181 effects calculation in accordance with equation A, and the result of it is used as the output of the high voltage unit 100.

After the termination of printing, the number of printed sheets is added to the print number of sheets read out from the memory means 30, and the sum is inputted to and stored in the memory means 30 through the reading-out/writing-in means 182.

The control of the image forming apparatus of the present embodiment will now be described with reference to the flowchart of FIG. 7. First, when it receives the input of an image signal from image signal input means such as a computer, the CPU 181 reads out the information of the print number of sheets from the memory means 30 through the reading-out/writing-in means 182 (step 1). Next, the judging means 183 judges whether the print number of sheets is within 50 sheets from the initial stage (step 2). If the print number of sheets exceeds 50 sheets, whether the print number of sheets is within 150 sheets is judged (step 3).

If here, the print number of sheets exceeds 150 sheets, a sufficient printing line width and printing density are obtained and therefore, printing is effected without the setting of the high voltage unit 100 being changed (step 4). The number of sheets printed at this time is added to the print number of sheets read out from the memory means 30 (step 5) and the sum is written into the memory means 30 through the reading-out/writing-in means 182 (step 6), thus ending the printing operation (step 7).

On the other hand, if at the step 2, the print number of sheets does not exceed 50 sheets, the CPU 181 sets the output voltage of the high voltage unit 100 to −550V (step 8), and advance is made to the step 4, whereafter a process similar to that described above is carried out. Also, if at the step 3, the print number of sheets does not exceed 150 sheets, the output voltage of the high voltage unit 100 is set to the result calculated on the basis of equation A (step 9), and advance is made to the step 4, whereafter a process similar to that described above is carried out.

As described above, according to the present embodiment, the surface potential of the photosensitive drum was changed in conformity with the amount of use of the process cartridge, whereby the fluctuations of the printing density and the printing line width could be prevented. Also, the change of the surface potential was done stepwise, whereby the line width could be prevented from becoming too thick. Also, memory means storing therein the information regarding the amount of use is disposed in the process cartridge. Therefore, even when another process cartridge is temporarily used, the adjustment of the line width and printing density can be effected in conformity with the process cartridge used.

While the present embodiment has been described with respect to a case where reverse development is effected, in an image forming apparatus wherein regular development is effected, the surface potential can be heightened to thereby obtain a similar effect when the process cartridge is in its initial state.

Embodiment 2

Figure 8:
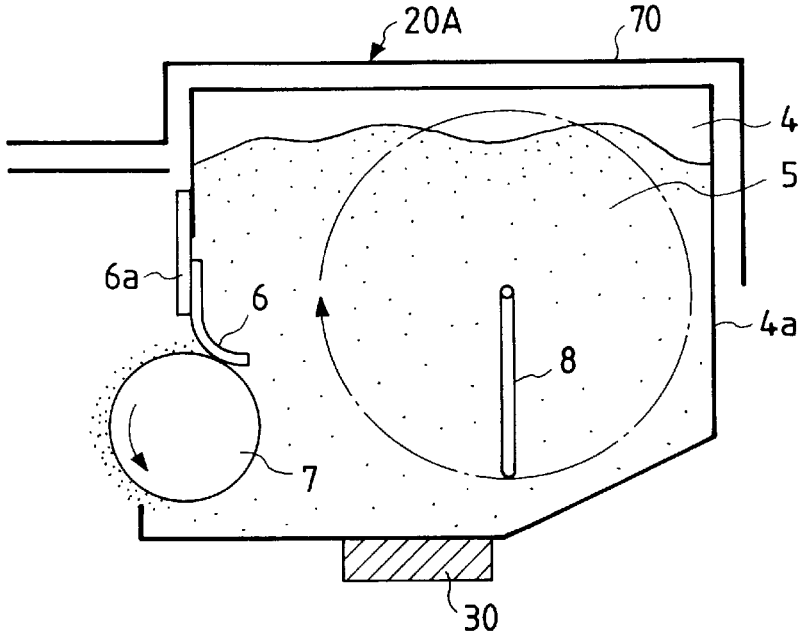
FIG. 8 shows the construction of a developing device in Embodiment 2 of the present invention.

FIG. 8 shows a developing device 20A made into a cartridge which is another embodiment of the present invention. The developing device 20A comprises a developer carrying member 7 such as a developing roller, and a developing container 4*a* containing a toner 5 therein to supply a developer (toner) to the developer carrying member 7, the developer carrying member 7 and the developing container 4*a* being integrally made into a cartridge by a frame member 70 made of plastic. That is, the developing device 20A of the present embodiment can be considered to be a cartridge in which the photosensitive drum 1, the charging roller 2 and the cleaning unit 10 are excluded from the process cartridge 20 described in Embodiment 1.

Accordingly, the description of Embodiment 1 is invoked for the description of the construction and action of the developing device 20A on which the memory means 30 is provided.

Embodiment 3

Embodiment 3 of the present invention will now be described with reference to FIGS. 9 and 10. This Embodiment 3 is characterized in that the developing bias applied to developing means is changed to thereby prevent the fluctuations of the printing line width and printing density from after the process cartridge has begun to be used.

The developing property of the image forming apparatus 18 can be adjusted by the magnitude of the contrast potential $V_{CNT}$ as described in Embodiment 1. Accordingly, assuming that the potential $V_L$ during the exposure of the surface of the photosensitive drum is constant, the developing bias $V_{DC}$ is changed in conformity with the amount of use of the cartridge 20, whereby a predetermined developing property can be maintained.

In Embodiment 3, $V_D$ was −650V, $V_L$ was −150V, and if the print number of sheets stored in the memory means of the cartridge was within 50 sheets, the developing bias $V_{DC}$ was −550V and the contrast potential $V_{CNT}$ was adapted to be −440V. Also, when the print number of sheets was 50 sheets to 150 sheets, the developing bias $V_{DC}$ was lowered by 5V for every 10 sheets.

Thereby, the printing line width from the initial stage of use of the cartridge 20 could be made appropriate. Also, thin density at the initial stage of use did not occur.

Figure 9:
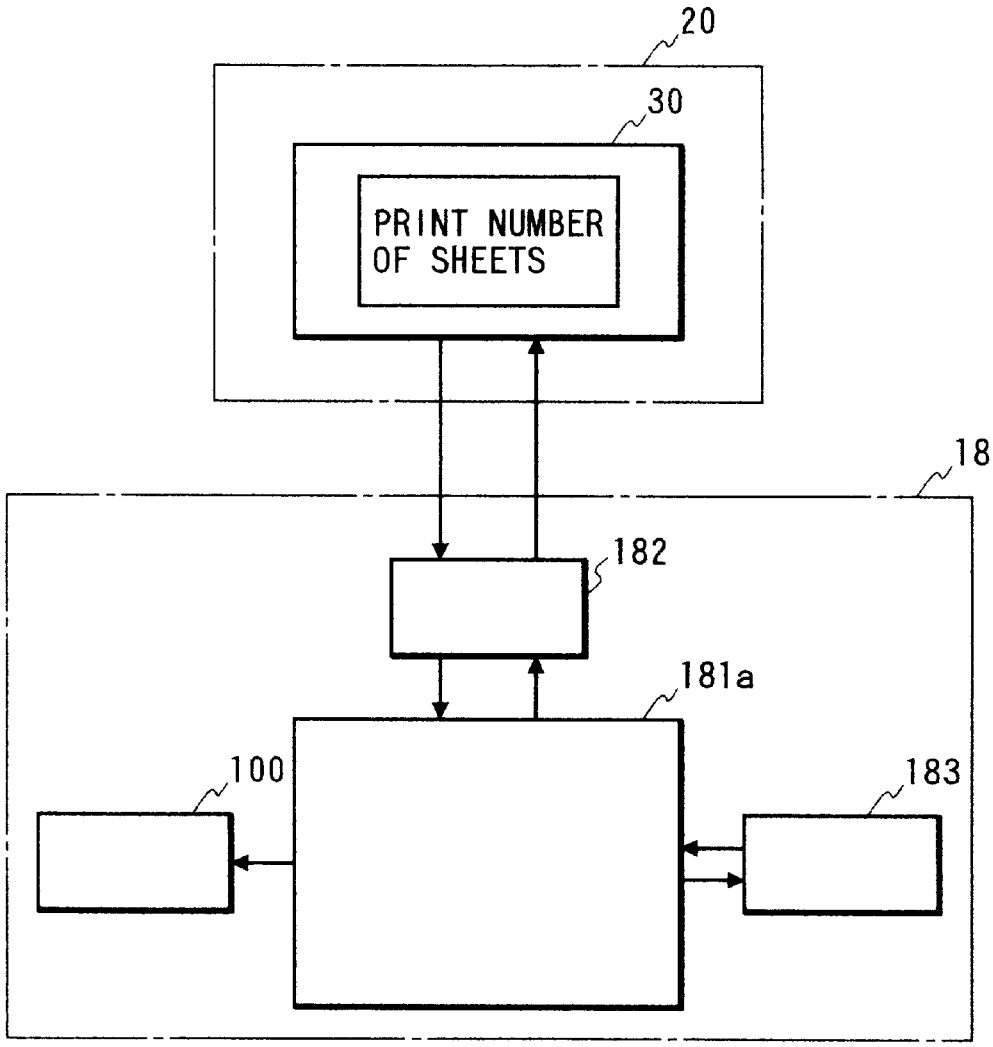
FIG. 9 is a block diagram of Embodiment 3 of the present invention.
Figure 10:
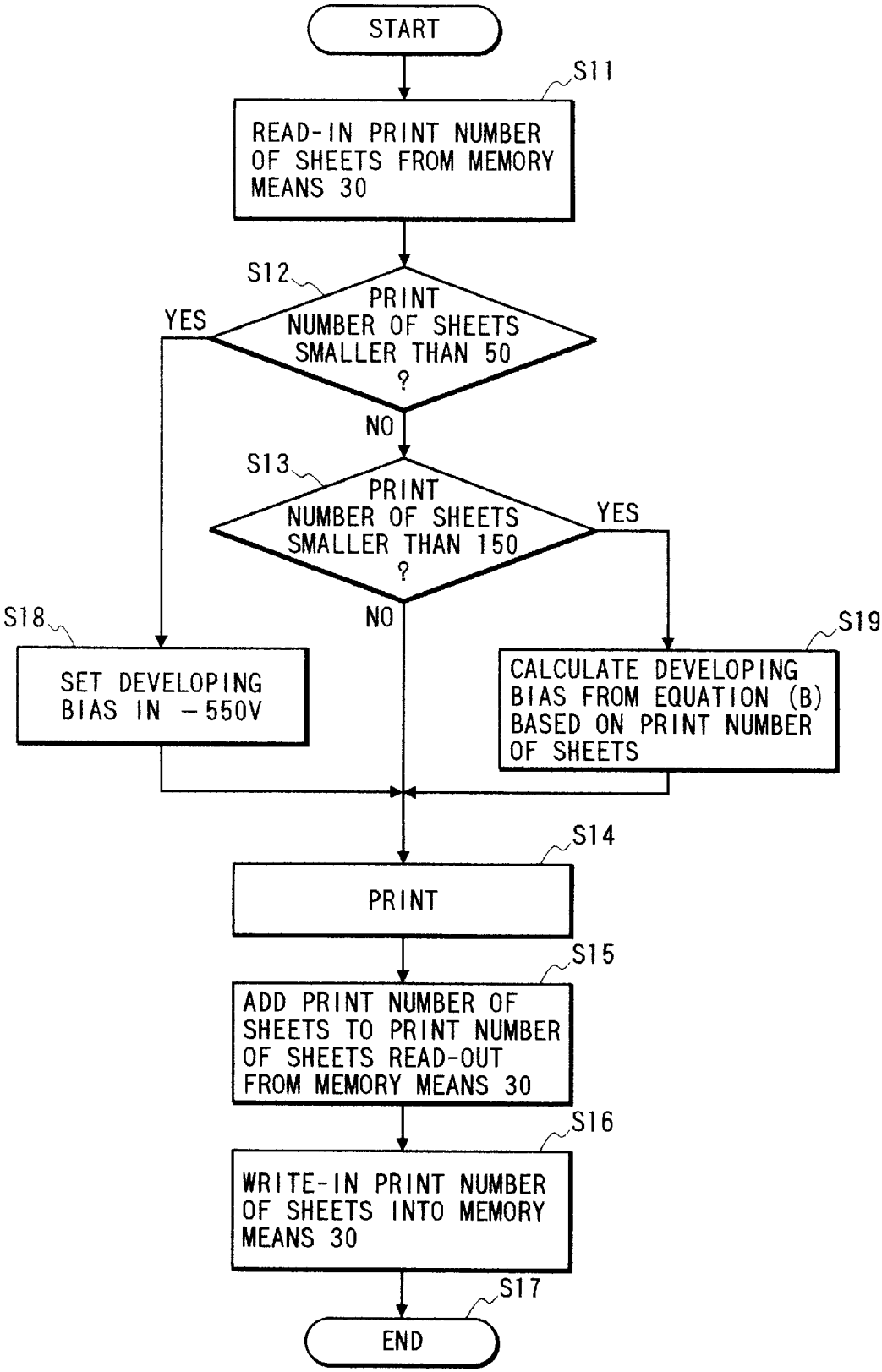
FIG. 10 is a flowchart of Embodiment 3.

FIG. 9 shows a block diagram of Embodiment 3. The cartridge 20 is provided with memory means 30 storing the print number of sheets therein, and the image forming apparatus 18 is provided with reading-out/writing-in means 182 for effecting the reading-out and writing-in of information relative to the memory means 30, judging means 183 for judging the amount of use of the cartridge 20 by the information read out from the memory means 30, a high voltage unit 100 and a CPU 181*a*. When it is judged from the print number of sheets stored in the cartridge 20 that it is soon after the cartridge 20 has begun to be used, the judging means 183 controls so that the CPU 181*a* may heighten the voltage of the developing bias outputted by the high voltage unit 100.

At this time, the developing bias $V_{DC}$ for the print number of sheets ranging from 50 sheets to 150 sheets is outputted on the basis of the following equation:

$$\text{output voltage} = -500 - (50 - [\text{print number of sheets} - 50/10] \times 5) \quad \text{(B)}$$

Also, after the termination of printing, the number of printed sheets is added to the print number of sheets read out from the memory means 30, and the sum is inputted to and stored in the memory means 30 through the reading-out/writing-in means 182.

The control of the image forming apparatus 18 of Embodiment 3 will now be made with reference to the flowchart of FIG. 10.

First, when it receives the input of an image signal from image signal input means such as a computer, the CPU 181*a* reads out the information of the print number of sheets from the memory means 30 through the reading-out/writing-in means 182 (step 11). Next, whether the print number of sheets is within 50 sheets from the initial stage is judged by the judging means 183 (step 12). If the print number of sheets exceeds 50 sheets, whether the print number of sheets is within 150 sheets is judged (step 13).

If here, the print number of sheets exceeds 150 sheets, a sufficient printing line width and printing density are obtained and therefore, printing is effected without the setting of the high voltage unit 100 being changed (step 14). The number of sheets printed at this time is added to the print number of sheets read out from the memory means 30 (step 15), and the sum is written into the memory means 30 by the reading-out/writing-in means 182 (step 16), thus ending the printing operation (step 17). If at the step 12, the print number of sheets does not exceed 50 sheets, the CPU 181*a* sets the output voltage of the high voltage unit 100 to −550V, and advance is made to the step 14, where a process similar to that described above is carried out.

Also, if at the step 13, the print number of sheets does not exceed 150 sheets, the output voltage of the high voltage unit 100 is set to the result calculated on the basis of equation B, and advance is made to the step 14, where a process similar to that described above is carried out.

As described above, according to Embodiment 3, the developing bias was changed in conformity with the amount of use of the process cartridge, whereby the fluctuations of the printing line width and printing density could be prevented. Also, the change of the developing bias was stepwisely effected, the line width could be prevented from becoming too thick.

Embodiment 4

Embodiment 4 of the present invention will now be described with reference to FIGS. 11 to 13. This Embodiment 4 is characterized in that when reverse development is to be effected, the exposure amount of the exposure device is changed to thereby change the potential $V_L$ during the exposure of the photosensitive drum and adjust the contrast potential $V_{CNT}$.

Figure 11:
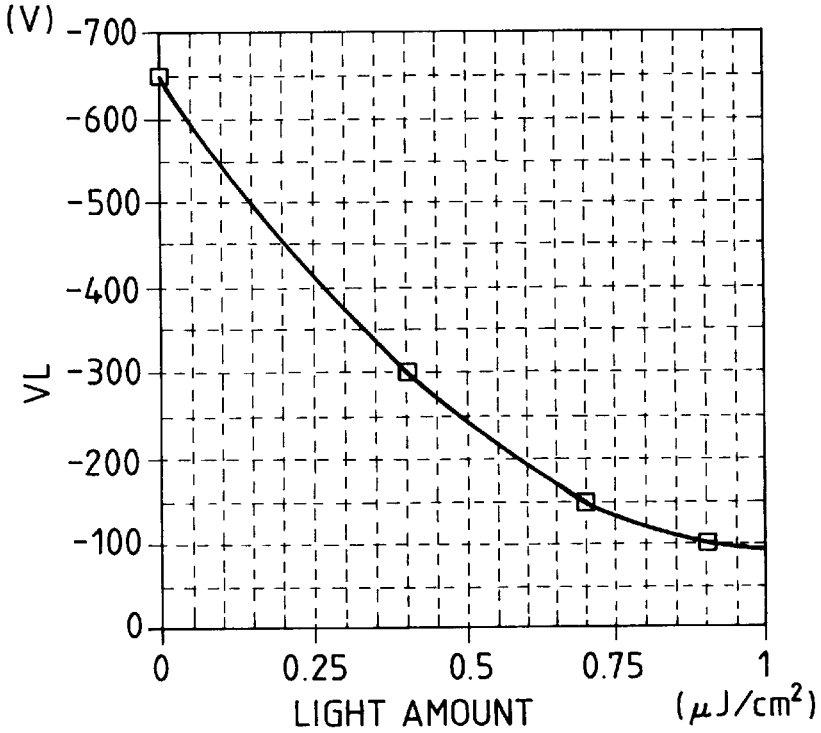
FIG. 11 is a graph showing the relation between the exposure amount of a photosensitive drum and the potential of the exposed portion thereof.

The relation between the exposure amount E and $V_L$ of the image forming apparatus of Embodiment 4 is shown in the graph of FIG. 11. By the graph of FIG. 11, in the image forming apparatus of the present embodiment, the exposure amount E is 0.7 $\mu J/cm^2$ in order that $V_L$ may be −150V. When the process cartridge is in its initial state, the necessary contrast potential $V_{CNT}$ is −400V from Embodiments 1 and 3, and when the developing bias $V_{DC}$ is constant, the then $V_L$ is −100V. So, from the graph of FIG. 11, for the print number of sheets from the initial stage to 50 sheets, the exposure amount E was 0.9 $\mu J/cm^2$, and for the print number of sheets ranging from 50 sheets to 150 sheets, the exposure amount E was changed by 0.02 $\mu J/cm^2$ for every 10 sheets. Thereby, the line width from the initial stage of use of the cartridge 20 could be made appropriate. Also, the thin density at the initial stage of use did not occur.

Figure 12:
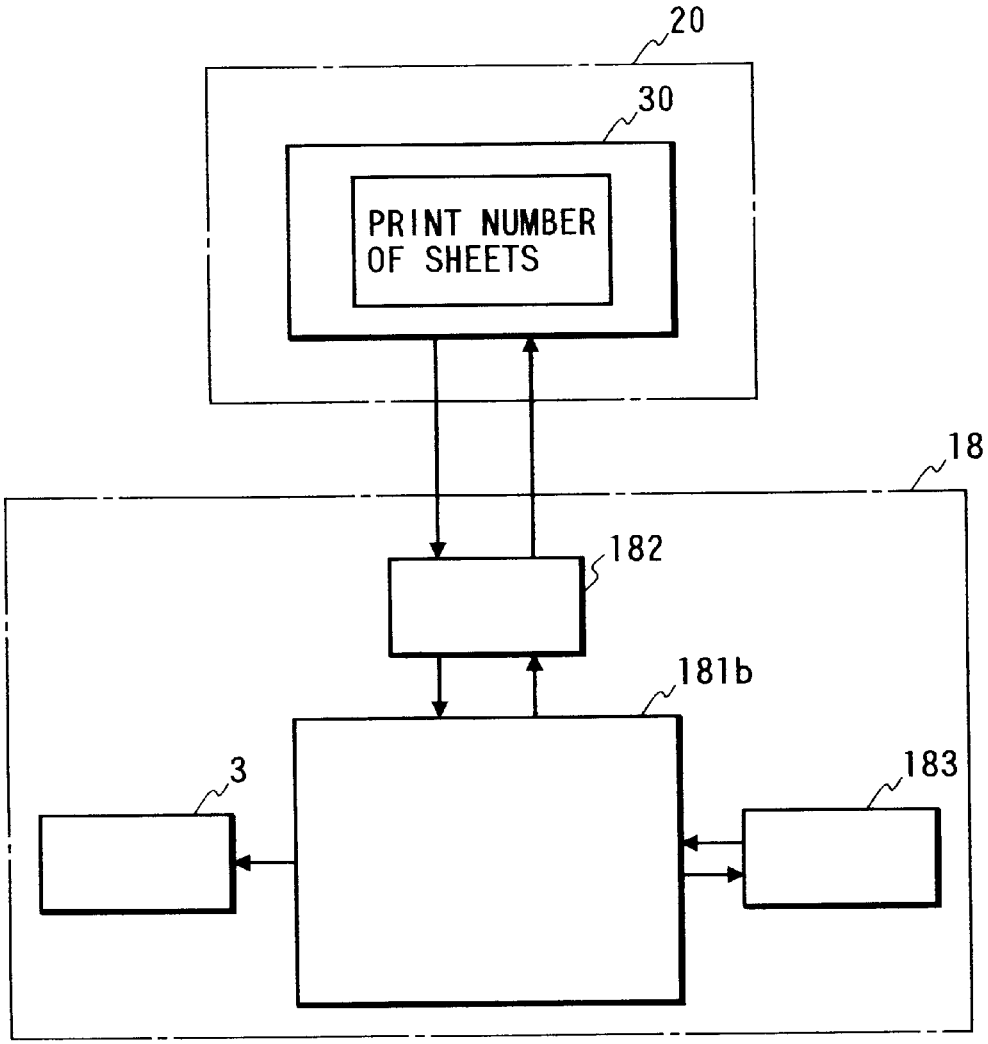
FIG. 12 is a block diagram showing Embodiment 4 of the present invention.
Figure 13:
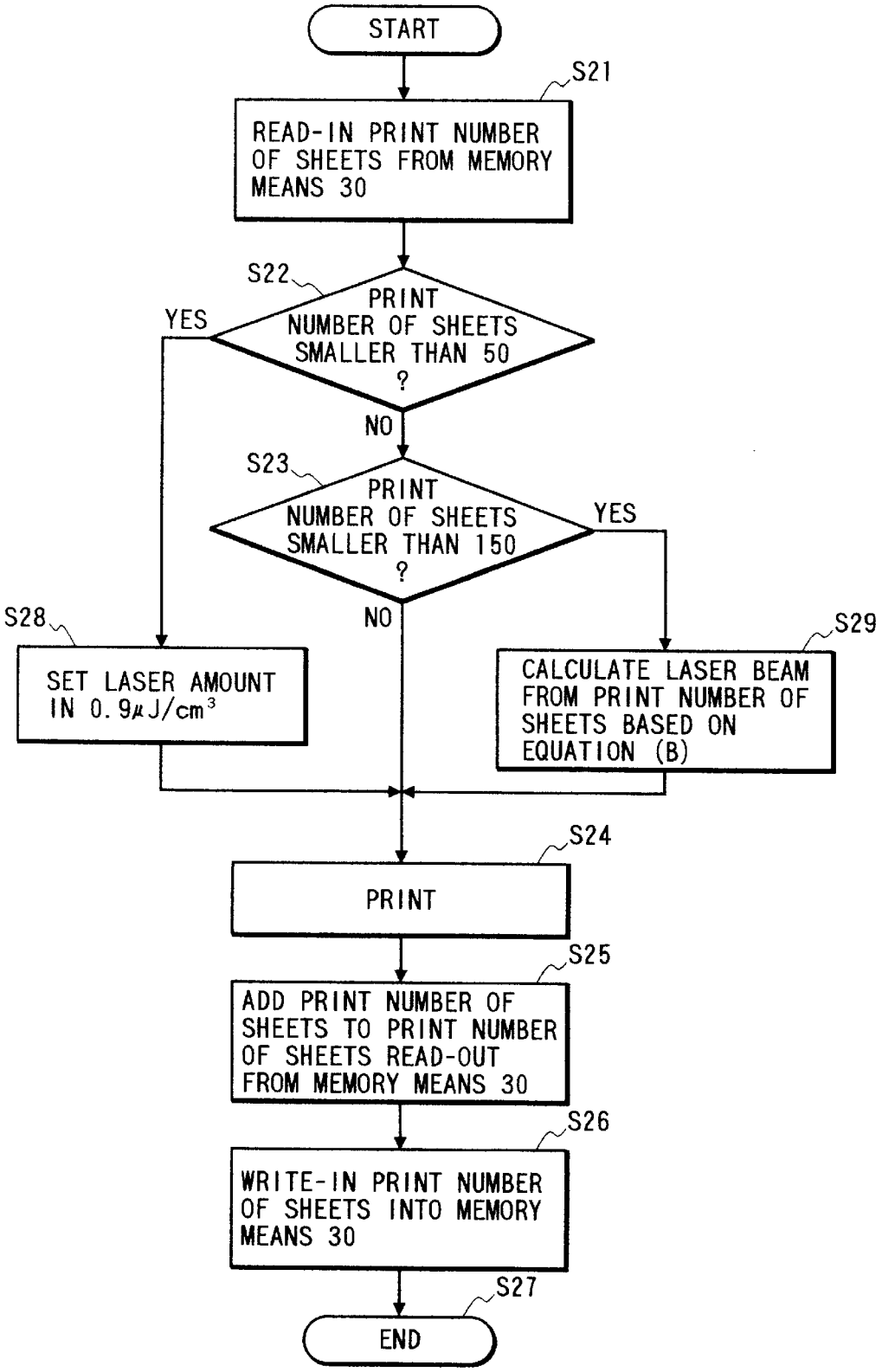
FIG. 13 is a flow chart of Embodiment 4.
Figure 14:
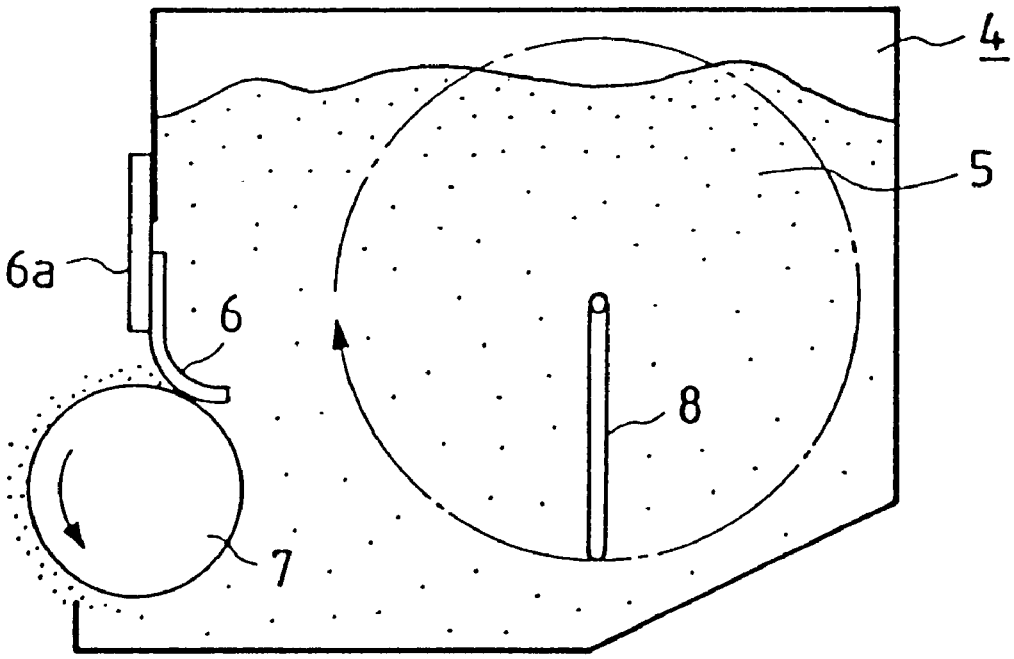
FIG. 14 PRIOR ART
FIG. 14 shows the construction of an example of the developing device according to the prior art.

Referring to FIG. 12 which shows a block diagram of Embodiment 4, the cartridge 20 is provided with memory means 30 storing the print number of sheets therein, and the image forming apparatus 18 is provided with reading-out/writing-in means 182 for effecting the reading-out and writing-in of information relative to the memory means 30, judging means 183 for judging the amount of use of the cartridge 20 from the information read out from the memory means 30, a high voltage unit 100 and a CPU 181*b*. When it is judged from the print number of sheets stored in the cartridge 20 that it is soon after the cartridge 20 has begun to be used, the judging means 183 controls so that the CPU 181*b* may heighten the quantity of laser light outputted by the exposure device 3.

At this time, the exposure amount E for the print number of sheets ranging from 50 sheets to 150 sheets is outputted on the basis of the following equation:

$$\text{exposure amount}=0.7+(0.2-[\text{print number of sheets}-50/10]\times 0.02) \quad \text{(C)}$$

The CPU 181*b* makes the result of the calculation of equation (C) into the quantity of laser light of the exposure device 3.

Also, when printing is terminated, the number of printed sheets is added to the print number of sheets read out from the memory means 30, and the sum is inputted to and stored in the memory means 30 through the reading-out/writing-in means 182.

The control of the image forming apparatus 18 of Embodiment 4 will now be described with reference to the flowchart of FIG. 13.

First, when it receives the input of an image signal from image signal input means such as a computer, the CPU 181*b* reads out the information of the print number of sheets from the memory means 30 through the reading-out/writing-in means 182 (step 21). Next, whether the print number of sheets is within 50 sheets from the initial stage is judged by the judging means 183 (step 22).

If the print number of sheets exceeds 50 sheets, whether the print number of sheets is within 150 sheets is judged (step 23). If here the print number of sheets exceeds 150 sheets, a sufficient printing line width and printing density are obtained and therefore, printing is effected without the setting of the exposure device 3 being changed (step 24). The number of sheets printed at this time is added to the print number of sheets read out from the memory means 30 (step 25), and the sum is written into the memory means 30 by the reading-out/writing-in means 182 (step 26), thus ending the printing operation (step 27).

On the other hand, if at the step 22, the print number of sheets does not exceed 50 sheets, the CPU 181*b* sets the laser output of the exposure device 3 to 0.9 $\mu J/cm^2$ (step 28), and advance is made to the step 24, where a process similar to that described above is carried out. Also, if at the step 23, the print number of sheets does not exceed 150 sheets, the laser output of the exposure device 3 is set to the result calculated on the basis of equation (C) (step 29), and advance is made to the step 24, where a process similar to that described above is carried out.

As described above, according to the present embodiment, the exposure amount was changed in conformity with the amount of use of the process cartridge, whereby the fluctuations of the printing line width and printing density could be prevented. Also, the change of the exposure amount was stepwisely effected, whereby the line width could be prevented from becoming too thick.

Of course, Embodiments 3 and 4 can be applied to the developing device of Embodiment 2, and the description of Embodiments 3 and 4 is invoked for the description thereof.

As is apparent from the foregoing description, according to the present invention, there can be provided a process cartridge and a developing device which can prevent the fluctuations of the density of a printed image and a line width constituting characters or figures in the initial state of use of the process cartridge or the developing device and in the state after the process cartridge or the developing device has been used for a while, and can maintain good image formation from the initial state of use, and an image forming apparatus on which such a process cartridge or developing device is mountable.

What is claimed is:

1. An image forming apparatus comprising:

a photosensitive member;

a charging means for charging said photosensitive member;

an exposing means for exposing a light including image information to said photosensitive member;

a developing means for supplying a toner to an electrostatic latent image formed on said photosensitive member, said developing means being held by a cartridge removably mountable on a main body of said image forming apparatus, said cartridge including a memory for memorizing an amount of use of the cartridge, wherein a charging amount of the toner caused by friction in said cartridge when the amount of use of said cartridge is in an initial state is smaller than that when the amount of use of said cartridge is not in an initial state;

a judging means for comparing the amount of use of said cartridge with a predetermined value showing a condition that the amount of use of said cartridge is in the initial state; and a control means for controlling operating parameters relating to at least one of said charging means, said exposing means, and said developing means, in accordance with a compared result of said judging means, so as to prevent thinning of an image line width until the amount of use of said cartridge reaches the predetermined value, wherein said control means changes the operating parameters until the amount of use of said cartridge reaches the predetermined value, and sets the operating parameters constant after the amount of use of said cartridge reaches the predetermined value.

2. An image forming apparatus according to claim 1, wherein said control means makes the applied voltage to said charging means higher, after the amount of use of said cartridge reaches the predetermined values, than the applied voltage before the amount of use reaches the predetermined value.

3. An image forming apparatus according to claim 1, wherein the amount of use of said cartridge is the number of printed sheets.

4. An image forming apparatus according to claim 1, wherein said memory is a semiconductor memory.

5. An image forming apparatus according to claim 1, wherein said cartridge also holds said photosensitive member.

6. An image forming apparatus according to claim 5, wherein said cartridge also holds said charging means.

* * * * *

UNITED STATES PATENT AND TRADEMARK OFFICE

CERTIFICATE OF CORRECTION

PATENT NO. : 6,229,970 B1
DATED : May 8, 2001
INVENTOR(S) : Tadashi Onimura et al.

It is certified that error appears in the above-identified patent and that said Letters Patent is hereby corrected as shown below:

Drawings,
In Fig. 1, replace Fig. 1 with the attached amended Fig. 1;
In Fig. 6, replace Fig. 6 with the attached amended Fig. 6;
In Fig. 9, replace Fig. 9 with the attached amended Fig. 9; and
In Fig. 12, replace Fig. 12 with the attached amended Fig. 12.

Column 1,
Line 35, "of" should read -- of the --; and
Line 51, "etc." should read -- etc., --.

Column 2,
Line 28, "i.e." should read -- i.e., --; and
Line 47, "flow chart" should read -- flowchart --.

Column 3,
Line 21, "by" should read -- by the --;
Line 31, "5a" should read -- 4a --;
Line 33, "blade" should read -- roller --;
Line 38, "pressure" should read -- voltage --; and
Line 44, "pressure" should read -- voltage --.

Column 4,
Line 43, "pressure" should read -- voltage --.

Column 5,
Line 4, "Accordingly" should read -- Accordingly, there is then provided --;
Line 21, "constants." should read -- constant. --;
Line 30, "then" should read -- thin --;
Line 33, "pressure" should read -- voltage --.
Line 59, "cartridge 20" should read -- memory means 30 --.

Column 7,
Line 9, "to" should read -- to the --;
Line 11, "from" should be deleted; and
Line 40, "cartridge 20" should read -- memory means 30 --.

UNITED STATES PATENT AND TRADEMARK OFFICE

CERTIFICATE OF CORRECTION

PATENT NO. : 6,229,970 B1 
DATED : May 8, 2001
INVENTOR(S) : Tadashi Onimura et al.

It is certified that error appears in the above-identified patent and that said Letters Patent is hereby corrected as shown below:

Column 8,
Line 24, "Also," should read -- Also, because --; and
Line 64, "cartridge 20" should read -- memory means 30 --.

Column 10,
Line 46, "values," should read -- value, --.

Signed and Sealed this

Ninth Day of July, 2002

*Attest:*

JAMES E. ROGAN
*Director of the United States Patent and Trademark Office*

*Attesting Officer*